US005310423A

United States Patent [19]

Aimoto et al.

[11] Patent Number: 5,310,423

[45] Date of Patent: May 10, 1994

[54] DEVELOPING UNIT HAVING CAPABILITY OF EFFICIENTLY EXCHANGING DEVELOPING POWDER

[75] Inventors: Toyoka Aimoto, Nara; Masato Asanuma, Ikoma, both of Japan

[73] Assignee: Sharp Kabushiki Kaisha, Osaka, Japan

[21] Appl. No.: 918,813

[22] Filed: Jul. 22, 1992

[30] Foreign Application Priority Data

| | | | |
|---|---|---|---|
| Oct. 31, 1991 | [JP] | Japan | 3-284558 |
| Nov. 8, 1991 | [JP] | Japan | 3-292631 |
| Nov. 22, 1991 | [JP] | Japan | 3-307442 |
| Dec. 2, 1991 | [JP] | Japan | 3-317978 |

[51] Int. Cl.[5] ..... G03G 15/06

[52] U.S. Cl. ..... 118/689; 355/246

[58] Field of Search ..... 355/246, 253, 259, 245, 355/251; 118/656-658, 688-691

[56] References Cited

U.S. PATENT DOCUMENTS

| | | | |
|---|---|---|---|
| 3,574,301 | 4/1971 | Bernhard . | |
| 4,219,271 | 8/1980 | Ohkubo et al. . | |
| 4,885,223 | 12/1989 | Enoki et al. | 355/253 X |
| 4,947,473 | 8/1990 | Kinashi | 355/259 |
| 4,970,557 | 11/1990 | Masuda et al. | 355/246 |
| 5,005,517 | 4/1991 | Fukui et al. | 355/246 X |

FOREIGN PATENT DOCUMENTS

| | | |
|---|---|---|
| 61-39061 | 2/1986 | Japan . |
| 61-269179 | 11/1986 | Japan . |

OTHER PUBLICATIONS

Abstract of Japanese Document (Kokai) 61-39061 Published Mar. 1986.

*Primary Examiner*—R. L. Moses

*Attorney, Agent, or Firm*—David G. Conlin; George W. Neuner

[57] ABSTRACT

A developing unit comprises a magnet roller, a stirring roller, a carrying screw, a toner density sensor, and a sensor level adjusting device. When feeding or exhausting the developing powder, the rollers and screw are driven at a slower or faster rotary speed than the speed given when developing an image. After the supply of the developing powder is terminated, the rotary speed of the rollers and the screw is changed to the speed given for developing an image. After a certain time is elapsed, the adjusting device serves to start the level adjustment when the sensor produces a stable output.

13 Claims, 12 Drawing Sheets

DEVELOPING UNIT HAVING CAPABILITY OF EFFICIENTLY EXCHANGING DEVELOPING POWDER

BACKGROUND OF THE INVENTION

1. Field of the Invention

The present invention relates to a developing unit included in an image forming apparatus of an electronic photography type, and more particularly to a mechanism for feeding or exchanging developing powder faster and a mechanism for adjusting a toner density sensor when the developing powder is fed into the developing unit, the mechanisms being provided in the developing unit.

2. Description of the Related Art

The inventors of the present application know a mechanism for feeding developing powder to a developing unit. The known mechanism includes a toner density sensor and is constructed so that when the sensor senses the absence of developing powder being removed in the developing unit, a rotary system for removing the waste developing powder is deactivated and a feeding unit is activated in response to the sensing signal, for feeding a necessary amount of new developing powder into the developing unit. This mechanism has been disclosed in Japanese Patent Lying Open No. 61-39061.

In the known mechanism, the rotary system such as rollers and screws provided in the developing unit is driven at a constant speed needed in a developing process. The same speed is maintained in feeding new developing powder, exhausting waste developing powder, and developing an image. Further, the feeding unit is kept driven until the necessary amount of new developing powder is charged in the developing unit.

Hence, the known mechanism may has a longer set time for exchanging the developing powder than the actually consuming time, because the time is set in consideration of the variety of the charging operation and the state of the developing powder. During the time, the image forming apparatus has to be kept untouched for a maintenance worker or a user. It means that the time when the mechanism is continued to be driven wastefully after supplying of the developing powder is a wasteful time for the maintenance worker or the user. The wasteful time results in making the operation efficiency lower.

Further, when doing the maintenance work, a photosensitive drum may be removed from an image forming apparatus in advance. When the developing powder is exchanged in this state, the developing powder may be splashed from the exposed surface of a magnet roller being driven for exchanging operation. The fall of the carrier and the splash of the toner result in soiling the inside of the image forming apparatus. It means that the splash of the developing powder has an adverse effect on the quality of the resulting image.

On the other hand, when feeding new developing powder, there are areas on which the developing powder is attracted and areas on which no developing powder is attracted on the surface of the magnet roller in rotation. Those areas are variable on the surface of the magnet roller according to the feeding amount of the developing powder. This may bring about the splash of toner and carrier inside of the image forming apparatus.

SUMMARY OF THE INVENTION

It is therefore a first object of the present invention to provide a developing unit which is capable of reducing an exchange time of the developing powder.

It is a second object of the present invention to provide a developing unit which is capable of eliminating a wasteful time taken after terminating the charge of new developing powder.

It is a third object of the present invention to provide a developing unit which is capable of preventing the splash of toner and carrier when exchanging developing powder.

In carrying out the first object, a developing unit according to a first aspect of the invention includes a developing bath; a roller for development and a screw for carrying developing powder, the roller and screw being rotatably fitted to the inside of the developing bath; and a unit for controlling a rotary speed of the roller and screw to be faster in a case of feeding new developing powder to the developing bath than that in a case of developing a copying image.

A developing unit according to a second aspect of the invention includes a developing bath; a roller for development and a screw for carrying developing powder, the roller and screw being rotatably fitted to the inside of the developing bath; and a unit for controlling a rotary speed of the roller and screw to be slower in a case of exhausting a waste developing powder from the developing bath than that in a case of developing a copying image.

In operation, when exchanging the developing powder, a discharging screw is rotated at the faster speed than the speed given when developing a copying image, so that the developing powder in the developing bath is moved more toward an inner side by virtue of the rotation of the screw when it is discharged.

Then, when charging the new developing powder, the rollers and the carrying screw are driven at the faster speed.

By setting the rotary speed of the rollers and screw faster in feeding or exhausting the developing powder than the speed in developing a copying image, therefore, it is possible to reduce the feeding time and the exhausting time of the developing powder.

In carrying out the second object, a developing unit according to a third aspect of the invention includes a developing bath; a roller rotatably fitted to the inside of the developing bath; a toner density sensor for sensing a toner density in the developing bath; a unit for feeding new developing powder to the developing bath; and a control unit for disabling the feeding unit and the roller when the toner density reaches a predetermined value.

In operation, immediately after starting to feed the developing powder, the toner density sensor produces substantially no output, because the developing powder does not reach the sensor yet. As the supply of the developing powder is progressing, the toner density becomes higher. Finally, the toner density is made to the density appearing when developing a copying image and then is kept stable.

Then, as comparing the reference value stored in the control unit with the output of the toner density sensor, when the output reaches the reference value, the developing powder feeding unit and the rollers are deactivated.

In carrying out the third object, a developing unit according to a fourth aspect of the invention includes a developing bath; a roller for development and a screw for carrying developing powder, the roller and screw being rotatably fitted to the inside of the developing unit; and a unit for controlling a rotary speed of the rollers and screw to be slower in feeding new developing powder to the developing bath than that given when developing an image.

A developing unit according to a fifth aspect of the invention includes: a developing bath; rollers for development and a screw for carrying developing powder, the rollers and screw being rotatably fitted to the inside of the developing unit; whereby a rotary speed of the rollers and screw is slower in exhausting waste developing power to the developing bath than that given when developing an image.

A developing unit according to a sixth aspect of the invention includes: a developing bath having an opening opposed to a photosensitive body; a magnet roller rotatably fitted near the opening; and a positioning mechanism for selectively positioning the developing bath at a first position where the developing process is performed or at a second position where the opening of the bath is opposed to a removing device when exhausting the developing powder; and a unit for controlling a rotary speed of the magnet roller to be slower when exhausting the developing powder than that given when developing an image.

In the operation of the developing units according to the fourth and the fifth aspects of the invention, when exchanging the developing powder, the exhausting screw is rotated at the slower speed than the speed given when developing a copying image so that the developing powder stored in the developing bath may be moved more toward an inner side by virtue of the rotation of the screw.

When feeding the new developing powder, the rollers and the carrying screw are driven at the slower speed.

By setting the speed of the rollers and the screws in feeding or exhausting the developing powder slower than the speed given in developing a copying image, therefore, it is possible to prevent the splash of toner and carrier due to the movement of the developing powder.

In the operation of the developing unit according to the sixth aspect of the invention, when exchanging the developing powder, the positioning mechanism is activated so as to switch a position of the developing bath from the developing posture into the exhausting posture. Then, the magnet roller is driven at a slower speed than a speed given in developing a copying image. The rotation of the magnet roller causes the developing powder to be exhausted from an opening to the removing unit.

Hence, the developing unit is capable of reliably traveling the developing powder into the removing unit and preventing the splash of carrier in discharging the developing powder.

Further objects and advantages of the present invention will be apparent from the following description of the preferred embodiments of the invention as illustrated in the accompanying drawings.

DESCRIPTION OF THE PREFERRED EMBODIMENTS

Herein, the description will be directed to a developing unit according to a first embodiment of the invention as referring to FIGS. 1 to 5.

Figure 1:
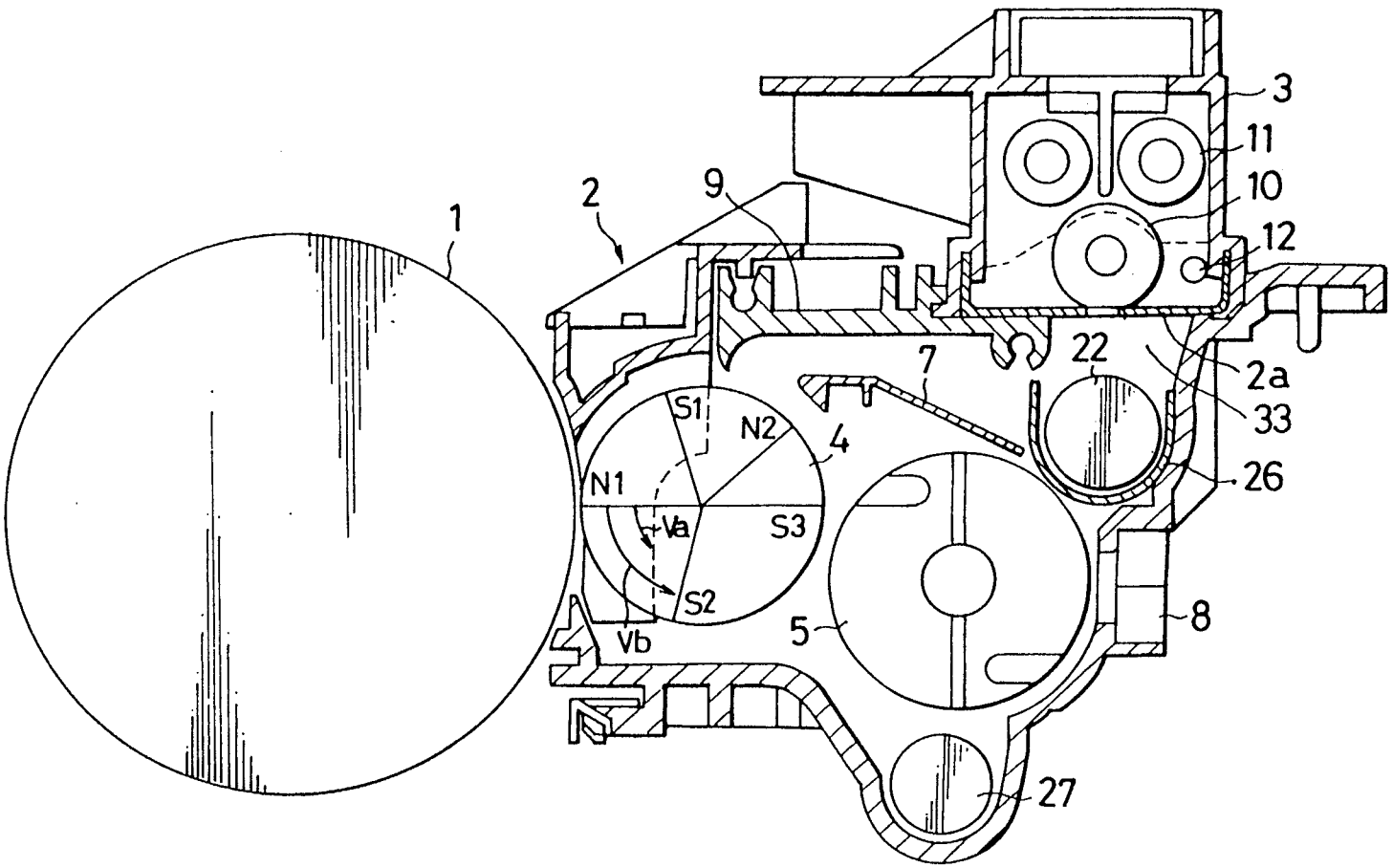
FIG. 1 is a section view showing a developing unit according to a first embodiment of the invention.

FIG. 1 is a sectional view showing the developing unit. As shown, 1 denotes a photosensitive drum. 2 denotes a developing bath. 3 denotes a toner hopper. 4 denotes a magnet roller. 5 denotes a stirring roller. 7 denotes a flow plate. 8 denotes a toner density sensor. 9 denotes a doctor. 10 denotes a toner feeding roller. 11 denotes a toner carrying screw.

Figure 2:
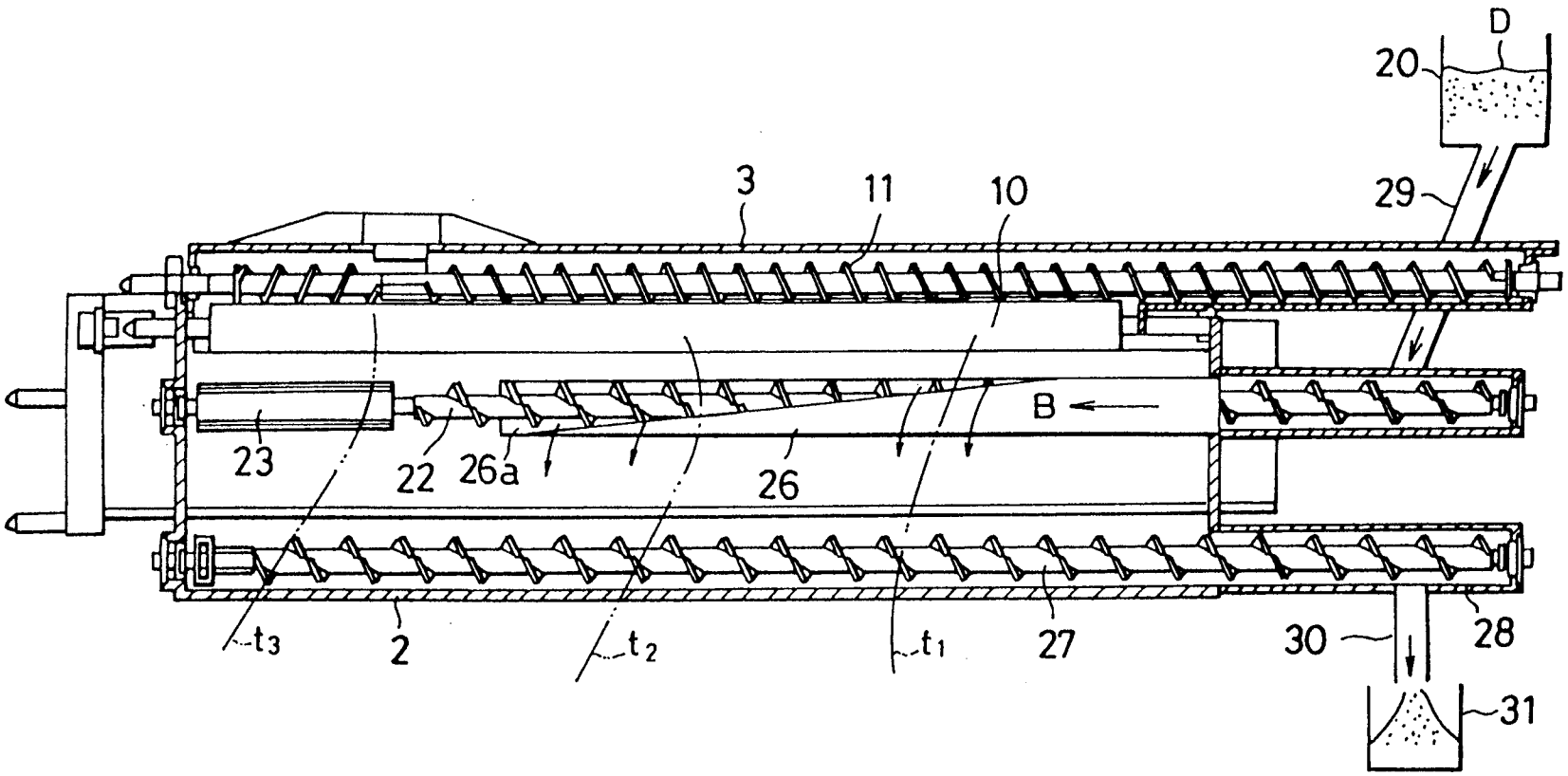
FIG. 2 is a side sectional view showing a developing unit shown in FIG. 1.

Turning to FIG. 2 showing the side of the developing unit, 20 denotes a feeding bath for feeding developing powder D into the developing bath. 21 denotes a carrying mechanism for carrying the developing powder D in the developing bath 2. The carrying mechanism 21 comprises a carrying screw 22 and a stirring member 23. The carrying screw 22 serves to carry the developing powder D from one side to the other side of the developing bath 2 along a longitudinal length. The stirring member 23 serves to stir the developing powder D circumferentially at the other side of the bath 2.

Figure 3:
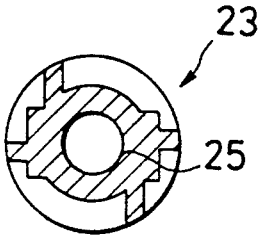
FIG. 3 is a section view showing an agitator included in the developing unit.

As shown in FIG. 1, the carrying mechanism is located immediately below an opening 2a of the developing bath 2 and in an obliquely upward of the stirring roller 5. As shown in FIG. 2, the carrying screw 22 is fitted inside of a cylinder 24 projected on the inside of the developing bath 2. The feeding bath 20 is connected to the cylinder 24 via a feeding pipe 20a. The carrying screw 22 is constructed to have a rotary shaft 25 and a spiral plate fitted on the rotary shaft 25. The stirring member 23 is composed of an agitator whose sectional form is as shown in FIG. 3. The stirring member 23 is mounted on the other side of the rotary shaft 25. Both ends of the rotary shaft 25 are rotatably supported by the developing bath 2 and the cylinder 24, respectively.

The developing powder D being fed from the feeding bath 20 is gradually carried through the feeding pipe 20a from the powder entry side of the developing bath 2 to the inner side of the bath, whereby the powder entry side means a side of the bath near the feeding bath 20 in the longitudinal direction of the developing bath. Since all the developing powder D is not carried, however, more of the developing powder D is left around the entry part than at the remaining part. That is, the distribution of the developing powder in the developing bath 2 is formed like a mountain whose tip is shifted to the entry side. Hence, the density of the developing powder D is higher around the entry part and gradually becomes lower toward the opposite side, that is, the inner side.

The irregular density of the developing powder D may give rise to an uneven-density image. To make the density even, it is necessary to stir the developing powder D again. Only the carrying screw 22, however, cannot achieve the efficient restirring operation.

To achieve the efficient re-stirring, there is a carrying path for the toner between the carrying screw 22 and a conduit pipe 26 as shown in FIG. 1. The conduit pipe 26 has an opening 26a (see FIG. 2) progressively increasing from the powder entry side to the opposite side of the developing bath. The conduit pipe 26 is formed around the carrying screw 22 like a U character in a manner that the opening 26a may be directed upward. The wall of the conduit pipe 26 opposite to the rotating direction of the carrying screw 22 is made gradually lower from the entry side to the opposite side.

Further, below the stirring roller 5, there is located an exhausting screw 27 for exhausting the waste developing powder D from the developing bath 2. Like the carrying mechanism 21, the exhausting screw 27 is fitted into a cylinder 28 projected on the inside of the developing bath 2 at the exhaust side. Both ends of the exhausting screw 27 are rotatably supported on the developing bath 2 and the cylinder 28, respectively.

The feeding bath 20 is connected to the cylinder 24 so that a shutter (not shown) is provided between the cylinder 24 and the feeding bath 20. The bath 20 may selectively communicate with the cylinder 24 if necessary through the effect of a shutter. The cylinder 24, the feeding bath 20 and the shutter compose a developing powder feeding mechanism 29.

The cylinder 28 is provided with an exhaust outlet 30 formed thereon, which is connected to a waste vessel 31. The exhaust outlet 30 is normally closed by a cap. The waste vessel 31 is located on the same side of the developing unit as the feeding bath 20 so that the waste vessel 31 may be easily removed from the image forming apparatus itself.

The magnet roller 4, the stirring roller 5, the carrying screw 22 and the exhaust screw 27 are rotated by a driving unit such as a motor through transmissions and gears. The driving unit is located on the opposite side of the developing unit in the image forming apparatus.

As one example of the driving unit 32, a high-speed and a low-speed driving units are alternately linked to the gear. Further, a clutch may be used for changing a transmission ratio.

To control the driving unit 32, a control unit 33 having a microcomputer is provided in the image forming apparatus.

Figure 4:
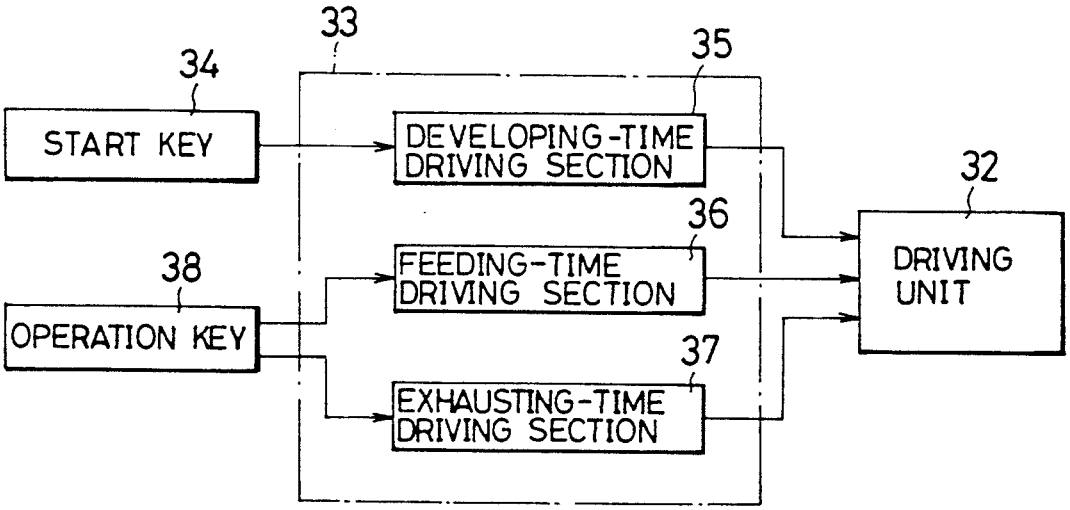
FIG. 4 is a block diagram showing a control unit included in the developing unit.

Turning to FIG. 4 showing the control of the developing unit, the control unit 33 is arranged to have a developing-time driving section 35, a feeding-time driving section 36, and an exhausting-time driving section 37. With a start key 34 being turned on, the developing-time driving section 35 serves to drive the rollers 4, 5 and the screws 22, 27 at a rotary speed Va synchronous with the speed given in the developing process. For feeding the new developing powder D, the feeding-time driving section 36 serves to drive the rollers 4, 5 and the screws 22, 27 at a faster rotary speed Vb than the rotary speed Va given when developing an image. For exhausting the old developing powder D, the exhausting-time driving section 37 serves to drive the rollers 4, 5 and the screws 22, 27 at the rotary speed Vb.

The feeding-time driving section 36 and the exhausting-time driving section 37 are actuated by switching an operation key 38 on for exchanging the developing powder D.

In a case that the waste developing powder D is exhausted and the new one is fed, the exhausting screw 27 is rotated at the rotary speed Vb by the driving unit 32. Then, the waste developing powder D in the developing bath 2 is moved in the A direction (see FIG. 2) by virtue of the screw 27 so that the waste developing powder D may drop from the exhaust outlet 30 into the waste vessel 31.

Next, when the new developing powder D is fed, the rollers 4, 5 and the carrying screw 22 are driven at the rotary speed Vb. The shutter is opened so that the new developing powder D may flow from the feeding bath 20 into the cylinder 24.

The developing powder D is rapidly carried from the entry side to the inner side by the carrying screw 22. The developing powder D overflown out of the opening 26a is progressively increased from the entry side to the inner side. Hence, the distribution of the developing powder D is not shifted toward the entry side. It means that no special stirring operation is required for feeding the developing powder uniformly. Then, the stirring roller 5 serves to charge the developing powder D in the developing bath 2.

The carrying screw 22 is used for carrying the developing powder D from the entry side to the inner side and provides excellent carrying efficiency. If the carrying screw 22 is extended to the tip of the rotary shaft 25 results in constantly moving the developing powder D in the B direction, thereby making the height of the developing powder D in the developing bath 2 irregular, which makes the toner density variable. Hence, the resulting copying image may be degraded.

To prevent the disadvantageous phenomenon, the stirring member 23 is provided on a end portion of the shaft 25 at the other side of the entry side as shown in FIG. 2. This stirring member 23 provides no capability of carrying the developing powder in the longitudinal direction but a more excellent capability of stirring the developing powder radially than the carrying screw 22. Hence, the developing powder D is carried toward the inner side by the carrying screw 22 and is diffused radially by means of the stirring member 23 to keep the density of the developing powder D uniform in the developing bath 2.

Figure 5:
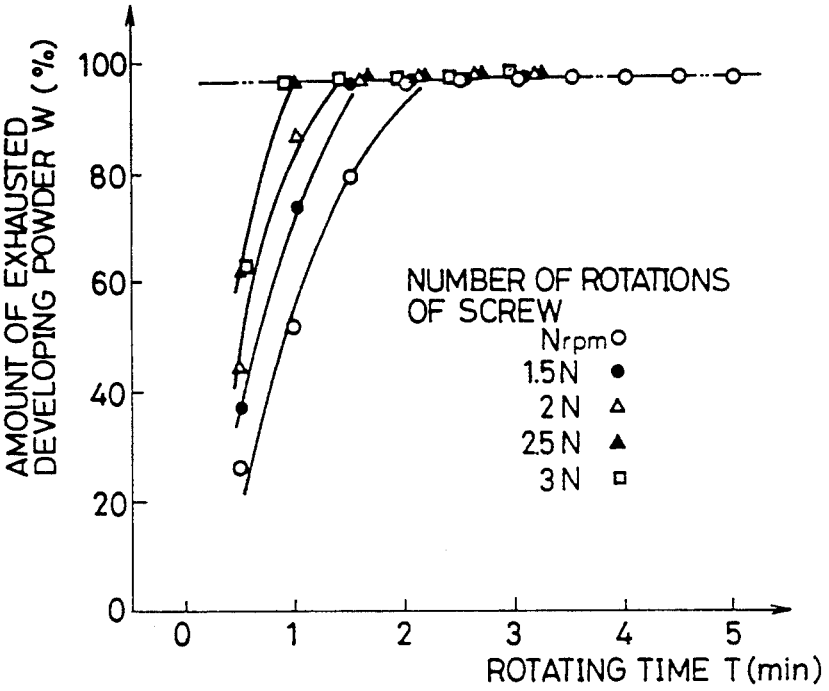
FIG. 5 is a graph showing a relation between a rotary speed of a roller and an amount of exhausted developing powder.

Turning to FIG. 5, a ratio of a rotation time to exhausted developing powder (amount of exhausted developing powder (g) v amount of initial developing powder (g)) is illustrated assuming the number of rotations of the exhausting screw as a parameter.

In FIG. 5, N rpm denotes the number of rotations of a screw when developing a normal copying image. As is obvious from FIG. 5, as the number of rotations is increased from N to 1.5N to 2N to 2.5N (3N), the amount of the exhausted developing powder D becomes larger.

As is apparent from the above description, by setting the rotary speed of the rotary system such as the rollers and the screws when feeding or exhausting the developing powder D faster than the speed given when developing a copying image, it is possible to reduce the feeding or exhausting time. It means that reduced is the time when the apparatus has to be kept untouched, in other words, the wasteful time when no other work can be done in the image forming apparatus.

In addition, in either feeding or exhausting the developing powder D, not both as described above, the faster rotary speed may be used.

In turn, the description will be directed to the developing unit according to a second embodiment as referring to FIGS. 1 to 3 and 6 to 8.

The construction and the operation of this embodiment are substantially same as those of the first embodiment. Hence, refer to the description about FIGS. 1 to 3 for the construction of this embodiment, except the toner density sensor 8 and the control unit 33.

Figure 7:
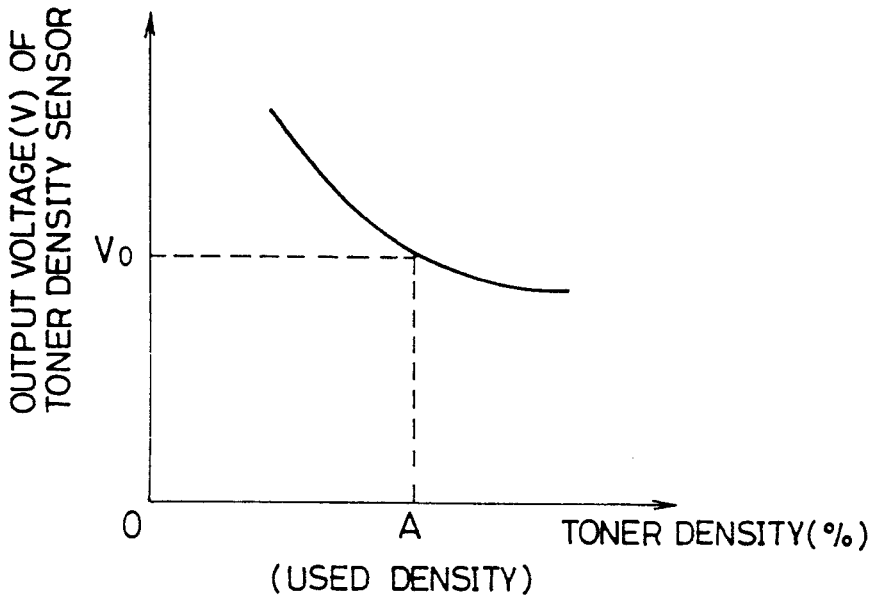
FIG. 7 is a graph showing a relation between an output voltage of a toner density sensor and an actual density.

A permeability sensor may be used as the toner density sensor 8 shown in FIG. 1, which serves to sense the amount of carrier of a constant volume on a sensing surface faced toward the inside of the developing bath 2, convert the sensed amount into the corresponding voltage and output the voltage. As shown in FIG. 7, with the increase of the toner density, the output voltage is decreased.

Figure 6:
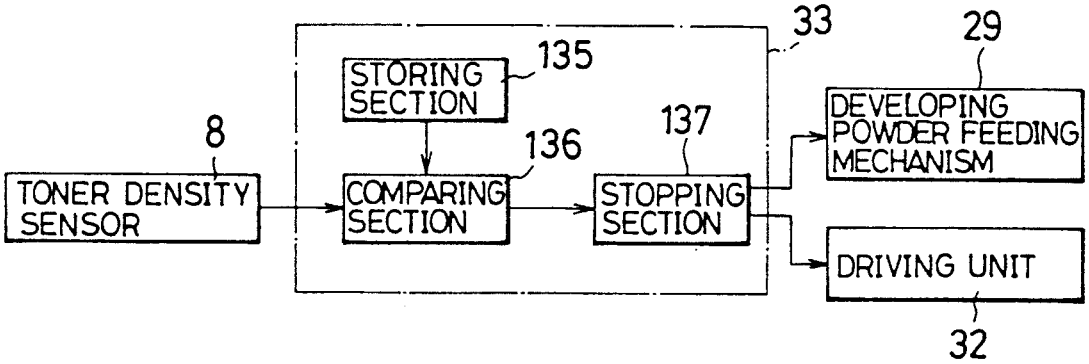
FIG. 6 is a block diagram showing a control unit included in a developing unit according to a second embodiment of the invention.

As shown in FIG. 6, the control unit 33 is arranged to have a storing section 135, a comparing section 136, and a stopping section 137. The storing section 35 serves to pre-store a reference voltage V0 of the toner density sensor 8. The reference voltage V0 corresponds to a toner density which is proper to the developing process. The comparing section 136 serves to compare the reference voltage V0 with the output voltage of the toner density sensor 8. If it is determined that the output voltage of the toner density sensor 8 reaches the reference voltage V0 in the comparing section 136, the stopping section 37 serves to stop the developing powder feeding mechanism 29 and the driving unit 32.

Consider the function of the toner density sensor 8 in a case that the new developing powder is exchanged with the waste powder. The exchanging operation is the same as that of the first embodiment.

Figure 8:
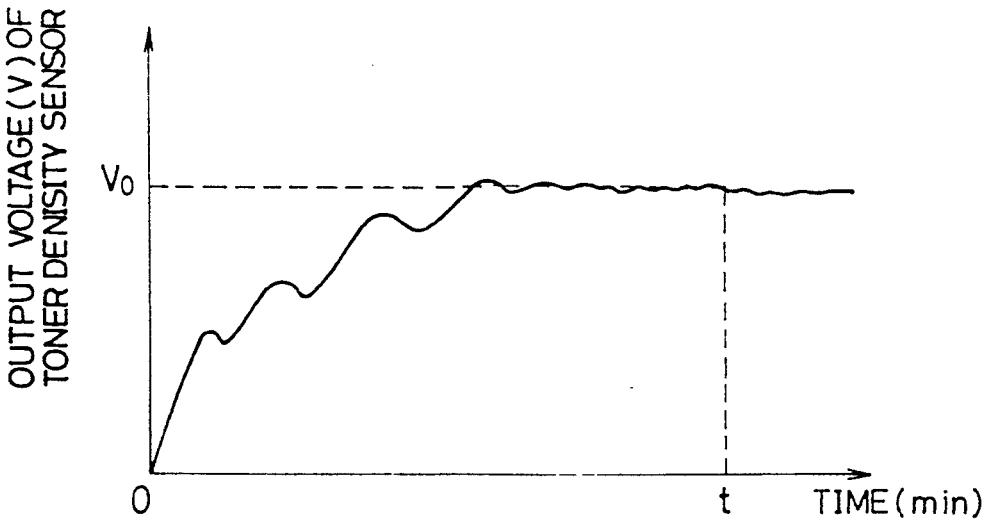
FIG. 8 is a graph showing a relation between an output voltage of the toner density sensor when feeding new developing powder and a time.

Immediately after starting to charge the developing powder, the developing powder does not reach the toner density sensor 8 yet. Hence, the sensor 8 senses the air existing around the sensing surface. Since the air does not contain magnetism, the air is detected as toner. The sensing result indicates "too much toner". That is, as shown in FIG. 8, the sensor produces an output voltage of 0 V or a value closing to 0 V. As the contact of the developing powder with the sensing surface of the sensor is increasing, the output voltage is gradually made higher. When the charge of the developing powder is terminated, the output voltage reaches the reference voltage VO (V) and then keeps the value.

As shown in FIG. 6 the comparing section 136 of the control unit 33 serves to compare the reference voltage VO stored in the storing section 35 with the output voltage of the toner density sensor 8. When the output of the sensor reaches VO, the stopping section 137 serves to deactivate the developing powder feeding mechanism 29, the carrying screw 22 and the rollers.

This results in eliminating the time when the developing powder feeding mechanism 29 and the relevant mechanisms are driven though the supply of the developing powder is actually terminated, thereby making the charging work of the developing powder more efficient.

In turn, the description will be directed to a developing unit according to a third embodiment of the present invention as referring to FIGS. 2 to 4 and 9.

Figure 9:
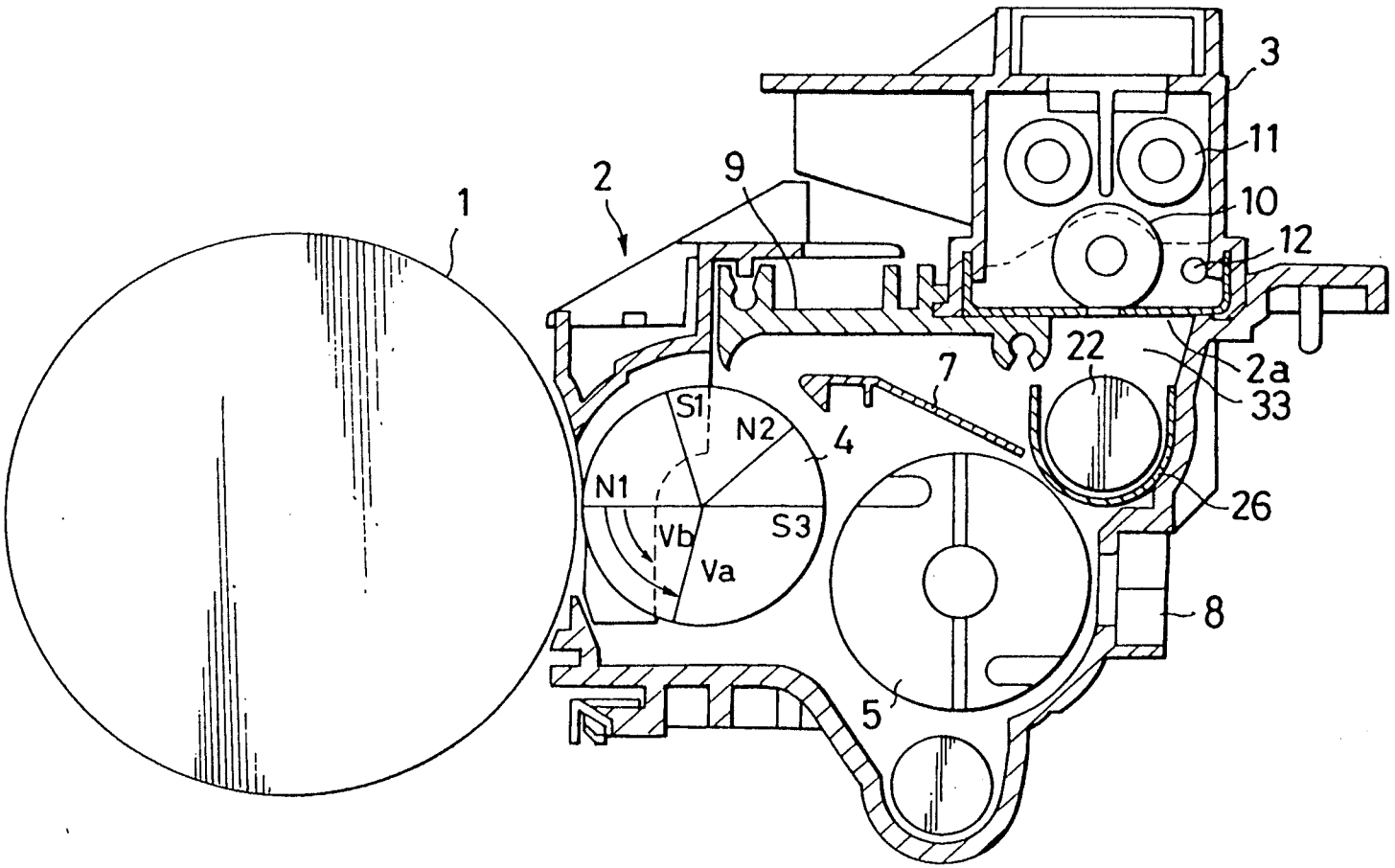
FIG. 9 is a section view showing a developing unit according to a third embodiment of the invention.

FIG. 9 shows the developing unit according to this embodiment. As is understood from the comparison between FIG. 1 (first embodiment) with FIG. 9, the rotary speed Vb of the magnet roller 4 in feeding or exhausting the developing powder is slower than the speed Vb given in the developing process in FIG. 9, while, in FIG. 1, the speed Vb is faster than the speed Va. The other components are the same as those of the first embodiment and have the same reference numbers. Hence, for the substantial construction and operation of this embodiment, refer to the description about FIGS. 1 to 4 of the first embodiment.

Turning to FIG. 4 showing the control of the developing unit, the control unit 33 is arranged to have a developing-time driving section 35, a feeding-time driving section 36, and an exhausting-time driving section 37. With a start key 34 being turned on, the developing-time driving section 35 serves to drive the rollers 4, 5 and the screws 22, 27 at a rotary speed Va synchronous with the speed given in the developing process. For feeding the new developing powder D, the feeding-time driving section 36 serves to drive the rollers 4, 5 and the screws 22, 27 at a slower rotary speed Vb than the rotary speed Va given when developing an image. For exhausting the old developing powder D, the exhausting-time driving section 37 serves to drive the rollers 4, 5 and the screws 22, 27 at the rotary speed Vb.

The feeding-time driving section 36 and the exhausting-time driving section 37 are actuated by switching an operation key 38 on for exchanging the developing powder D.

In a case that the waste developing powder D is exhausted and the new one is fed, the exhausting screw 27 is rotated at the rotary speed Vb by the driving unit 32 as shown in FIG. 2. Then, the waste developing powder D in the developing bath 2 is moved in the A direction by virtue of the screw 27 so that the waste developing powder D may drop from the exhaust outlet 30 into the waste vessel 31.

Next, when the new developing powder D is fed, the rollers 4, 5 and the carrying screws 22 are driven at the rotary speed Vb (see FIG. 1). The shutter (not shown in FIGS.) is opened so that the new developing powder D may flow from the feeding bath 20 into the cylinder 24.

At this time, as shown in FIG. 2, the developing powder fed into the developing bath 2 is moved from t1 to t2 to t3 (sec), that is, from the entry side to the inner side along the passage of time. That is, at t1 (sec), the developing powder is filled from the t1 line to the right hand as viewed in FIG. 2 but is not filled from the t1 line to the left hand. The border line is moved as the time is elapsed.

Hence, the developing powder is moved on the surface of the magnet roller in parallel to the shaft of the roller (in the thrusting direction), though the developing powder is moved on the magnet roller in a radial direction under the developing process. It means that the splash of toner or carrier is more likely to take place when feeding or exhausting the developing powder than when developing a copying image.

The carrying screw 22 serves to carry the developing powder D from the entry side to the inner side in the B direction at a slower speed than the speed given in the developing process. This results in slowing the movement of the developing powder on the surface of the photosensitive body 1, thereby making the developing powder more attracted on the photosensitive body 1. This prevents the splash of toner or carrier.

The developing powder D overflown out of the opening 26*a* is progressively increased from the entry side to the inner side. Hence, the distribution of the developing powder D is not shifted toward the entry side. It means that no special stirring operation is required for feeding the developing powder uniformly. Then, the stirring roller 5 serves to charge the developing powder D in the developing bath 2.

The carrying screw 22 is used for carrying the developing powder D from the entry side to the inner side and provides excellent carrying efficiency. The extension of the carrying screw 22 to the tip of the rotary shaft 25 results in constantly moving the developing powder D in the B direction, thereby making the height of the developing powder D in the developing bath 2 irregular, which makes the toner density variable. Hence, the resulting copying image may be degraded .

To prevent the disadvantageous phenomenon, the stirring member 23 is provided on the inner side. This stirring member 23 provides no capability of carrying the developing powder in the B direction but a more excellent capability of stirring the developing powder radially than the carrying screw 22. Hence, the developing powder D is carried toward the inner side by the carrying screw 22 and is diffused radially by means of the stirring member 23 for the purpose of keeping the density of the developing powder D uniform in the developing bath.

By setting the rotary speed of the rollers and the screws when feeding and exhausting the developing powder slower than the speed given in the developing process, therefore, the movement of the developing powder is made slower so as to prevent the splash of toner or carrier. This prevention leads to protecting the inside of the image forming apparatus from being soiled.

Further, the movement of the developing powder is made more reliable. Hence, the developing powder left in the developing bath becomes smaller, resulting in enhancing the exhausting efficiency.

In the above description, the slower rotary speed is used for both feeding and exhausting the developing powder D. However, it may be used for either one.

Next, the description will be directed to a developing unit according to a fourth embodiment of the present invention as referring to FIGS. 10*a* to 15.

Figure 10A:
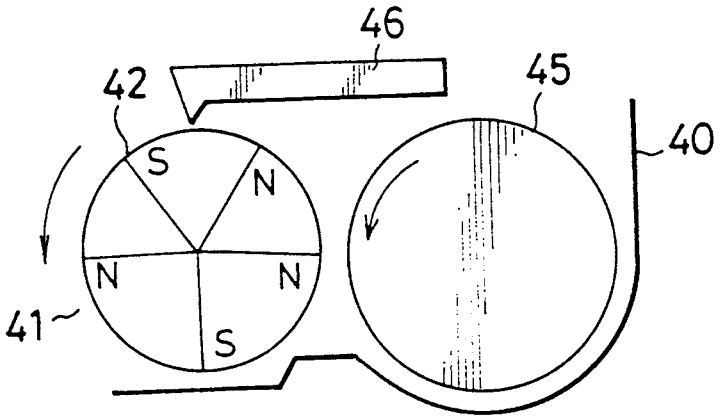
FIG. 10*a* is a view showing a developing bath according to the fourth embodiment of the invention.
Figure 10B:
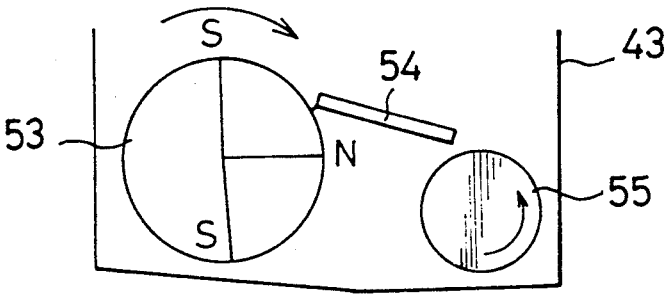
FIG. 10*b* is a view showing a recovery device according to the forth embodiment of the invention.
Figure 11:
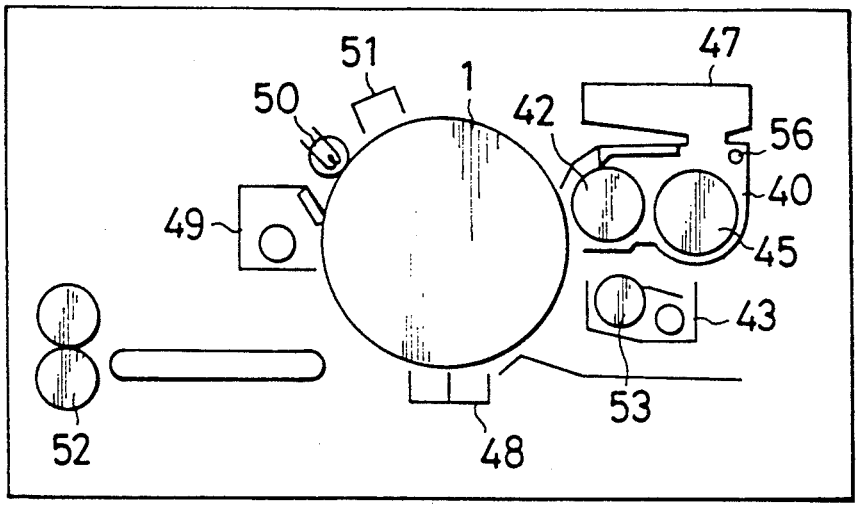
FIG. 11 is a view schematically showing an image forming apparatus having the developing unit shown in FIG. 11.

As shown in FIGS. 10*a* and 11, the developing unit according to this embodiment includes an opening 41 formed on a developing bath 40. The opening 41 is located as opposed to a photosensitive body 1. A magnet roller 42 is rotatably provided close to the opening 41. A switching mechanism is also provided for switching the posture of the developing bath 40 from a developing posture to an exhausting posture or vice versa. In the exhausting posture, the opening 41 is located as opposed to the recovery device 43.

Figure 12:
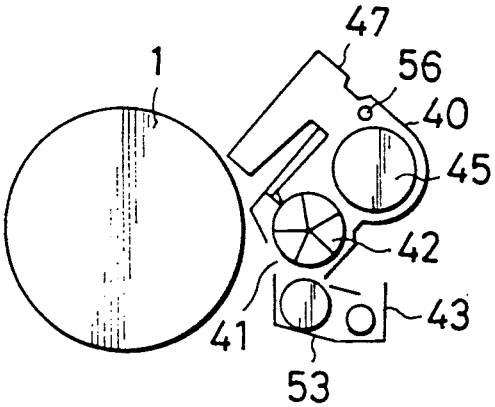
FIG. 12 is a view showing the developing unit positioned in an exhausting posture.

In FIGS. 11 and 12, 45 denotes a stirring roller, 47 denotes a toner hopper, 48 denotes a transfer charger, 49 denotes a cleaning unit, 50 denotes a discharging lamp, 51 denotes a charger, and 52 denotes a fixing unit.

The recovery device 43 is located below the developing bath 40 and includes a recovery magnet roller 53, a stripping member 54, and a screw 55. The recovery magnet roller 53 serves to attract the developing powder left on the magnet roller 42 of the developing bath 40 by means of magnetic force. The stripping member 54 serves to strip the developing powder left on the recovery magnet roller 53. The screw is operated to carry the stripped developing powder into a waste vessel (not shown). The recovery magnet roller 53 and the screw are rotated only when exhausting the developing powder by means of a motor (not shown).

The developing bath 40 is rotatably supported on the main body of the image forming apparatus through a shaft 56. The switching mechanism is constructed by a combination of a motor, a gear and a belt or a solenoid. The switching mechanism serves to switch the developing bath 40 from the developing posture to the exhausting posture or vice versa. In the developing posture, the magnet roller 42 is located as opposed to the photosensitive body 1. In the exhausting posture, as shown in FIG. 13, the developing bath 40 is rotated downwardly so that the magnet roller 42 is opposed to the recovery magnet roller 53.

Figure 13:
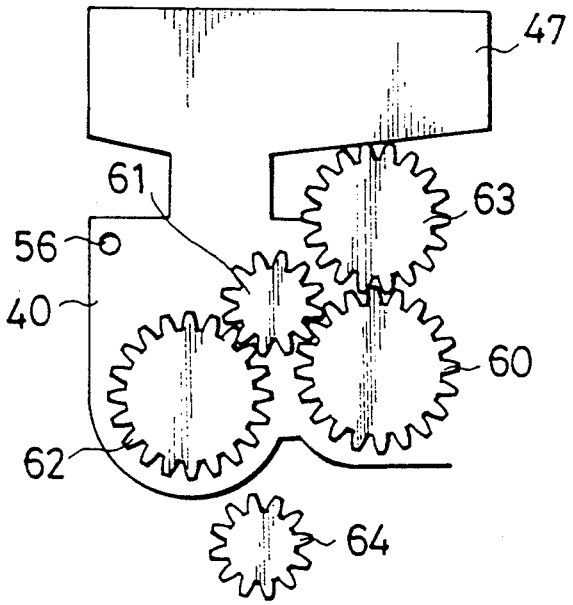
FIG. 13 is a background view showing the developing unit positioned in a developing posture.
Figure 14:
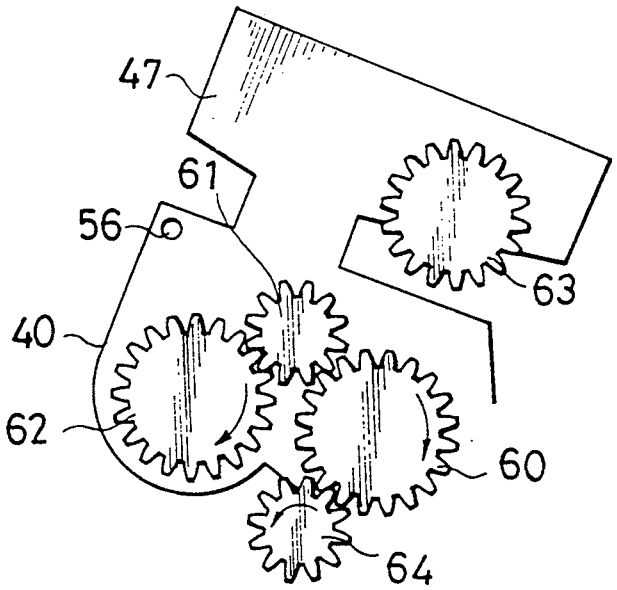
FIG. 14 is a background view showing the developing unit positioned in an exhausting posture.

On the back of the developing unit, as shown in FIGS. 13 and 14, there are located a driving gear 60 and a stirring gear 62. The driving gear 60 is fitted to the shaft of the magnet roller 42 and the stirring gear 62 is fitted to the shaft of the stirring roller 45 connected to the driving gear 60 through a medium gear 61. In the developing posture, the driving gear 60 is engaged with a driving gear 63 for development (referred to as a developing gear) provided on the main body of the image forming apparatus. In the exhausting posture, the driving gear 60 is engaged with a driving gear 64 for exhaust (referred to as an exhaust gear) disposed on the main body.

Figure 15:
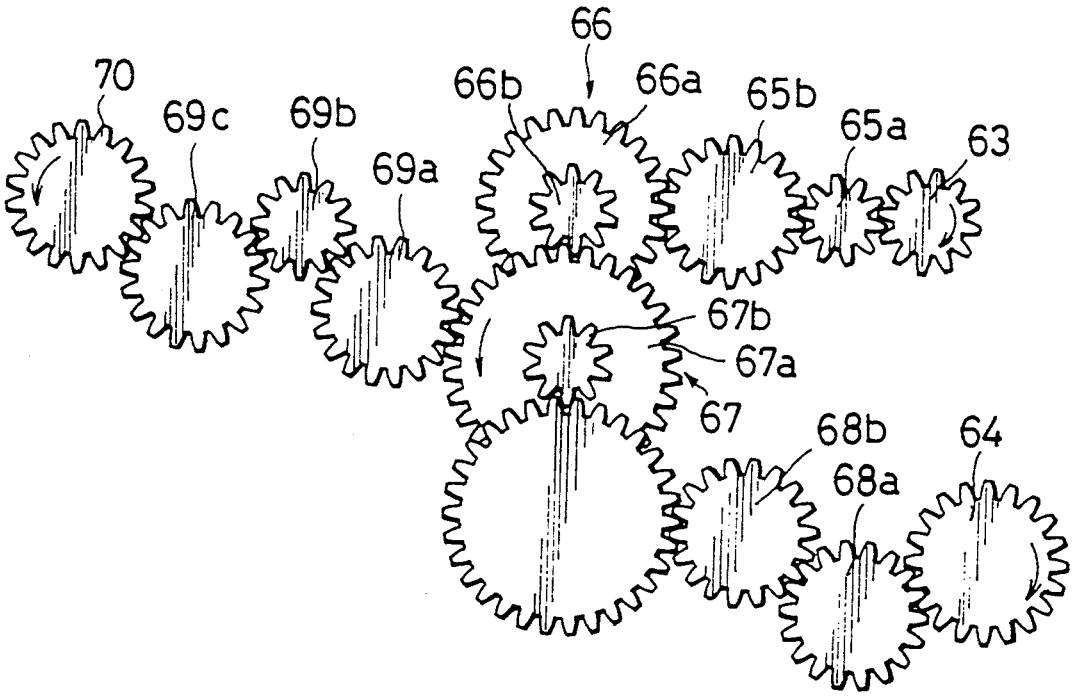
FIG. 15 is a view showing a system for transmitting driving force to the developing unit.

As shown in FIG. 15, the developing gear 63 is linked to a large gear 66*a* of a two-stage gear 66 through medium gears 65*a* and 65*b*. A small gear 66*b* of the two-stage gear 66 is engaged with a large gear 67*a* of a central two-stage gear 67.

The exhaust gear 64 is linked to a small gear 67*b* of the central two-stage gear 67 through medium gears 68*a*, 68*n* and 68*c*.

The large gear 67*a* of the central two-stage gear 67 is linked to an output gear 70 through medium gears 69*a*, 69*b* and 69*c*. The output gear 70 is connected to a main motor. The driving force of the main motor is transmitted to the developing gear 63. During the transmission, the driving force is accelerated through the gears. In the developing process, the magnet roller 42 is rotated at a normal rotary speed of 200 to 300 rpm.

On the other hand, the driving force of the main motor is also transmitted to the exhaust gear 64. In this case, unlike the transmission to the developing gear 63, the driving force is decelerated through the gears. In exhausting the waste developing powder, the magnet roller 42 is rotated at a rotary speed of 100 rpm or less.

In the foregoing construction, to exchange the waste developing powder, at first, by pressing an operation key for exhausting the developing powder, the switching mechanism is activated so that the developing bath 40 is rotated on the shaft 56 for switching the developing bath 40 from the developing posture to the exhausting posture.

Then, the driving gear 60 is spaced from the developing gear 63 and is engaged with the exhaust gear 64. The driving force of the main motor is transmitted to the exhaust gear 64 through the central two-stage gear 67, so that the magnet roller 42 and the stirring roller 45 may be rotated. At this time, the rotary speed of the magnet roller 42 and the stirring roller 45 is faster than that in the developing process.

The developing powder attracted on the magnet roller 42 is stripped by virtue of the magnetic force of the recovery magnet roller 53 and thus is attracted by the recovery magnet roller 53. The attracted developing powder is stripped by the stripping plate 54 and is carried to the waste vessel by a screw 55.

As described above, when exhausting the developing powder, the developing unit is rotated at a slower speed than the speed when developing a copying image. The developing powder is allowed to be reliably carried to the recovery magnet roller 53. This can prevent the splash of carrier or toner and enhance the efficiency of the exhausting work. Hence, no waste developing powder is left in the developing bath 40 and the splash of toner does not soil the inside of the image forming apparatus. This results in preventing the resulting image from being adversely effected.

As an alternative construction of the driving unit 32, two system driving units for high speed or low speed are alternately linked to the gear. Further, it is possible to use a clutch for changing a gear ratio.

In the third embodiment above mentioned, it is proposed that the rotary speed of the rotary elements in feeding the developing powder is slower than that in developing an image as a technique for overcoming the splash of toner or carrier inside of the image forming apparatus. However, this technique causes a new problem to the toner sensor.

The toner density sensor must be adjusted so that a voltage of the output signal thereof has a predetermined level after a given amount of the new developing powder is charged. The level setting done at a slower rotary speed for charging new developing powder is different from that done at a faster rotary speed for developing a copying image. The change of flow of developing powder due to the speed difference of the roller results in giving rise to the change of an output voltage in the toner density sensor. It leads to the change of a toner density when developing a copying image. The resulting image is thus made degraded.

The description will be directed to the developing unit according to a fifth embodiment of the present invention as referring to FIGS. 1 to 3 and 16 to 19. The embodiment is directed to a technique for overcoming this disadvantage.

The construction and the operation of this embodiment are substantially same as those of the first embodiment. Hence, refer to the description about FIGS. 1 to 3 for the construction of this embodiment, except the toner density sensor 8 and the control unit 33.

Figure 17:
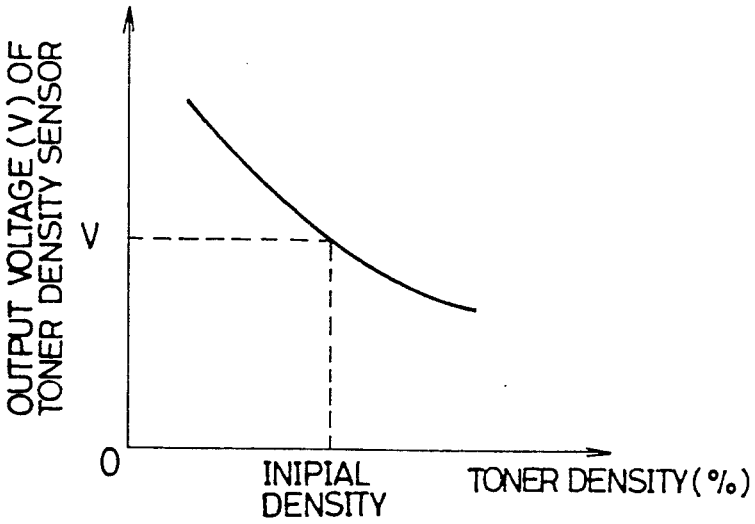
FIG. 17 is a graph showing an output characteristic of a toner density sensor included in the developing unit.
Figure 18:
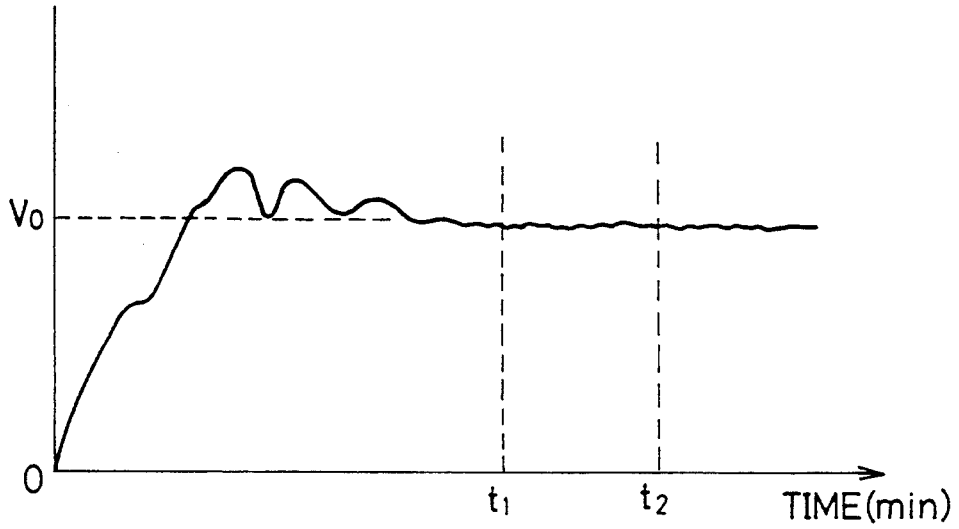
FIG. 18 is a graph showing a relation between an output voltage of the toner density sensor and a time.

The toner density sensor 8 shown in FIG. 1 may use a permeability sensor, which serves to sense the amount of carrier of a constant volume on a sensing surface faced toward the inside of the developing bath 2, convert the sensed amount into the corresponding voltage and output the voltage. As shown in FIG. 17, with the increase of the toner density, the output voltage is decreased.

Figure 16:
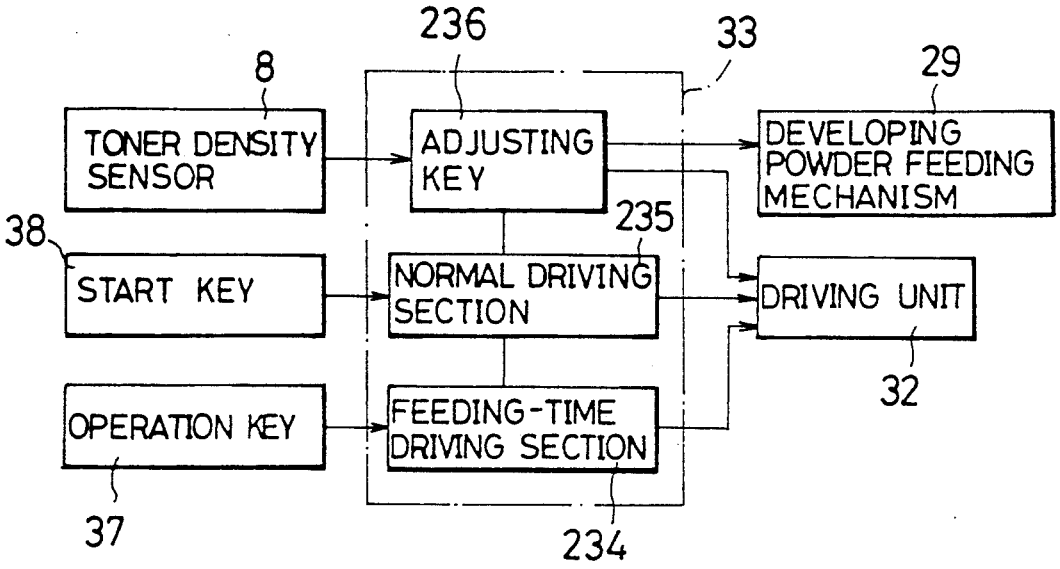
FIG. 16 is a block diagram showing a control unit included in a developing unit according to a fifth embodiment of the invention.

In this embodiment, the control unit 33 serves as a density level adjusting device as shown in FIG. 16 and is disposed in the main body of the image forming apparatus. This density level adjusting device 33 comprises a microcomputer and controls the driving unit for adjusting the setting level of the output voltage of the toner density sensor 8.

The adjusting device 33 is arranged to have a feeding-time driving section 234, a normal driving section 235, and an adjusting section. The feeding-time driving section 234 serves to drive the rollers 4, 5 and the screw 22 at a slower rotary speed Vb than Va in feeding new developing powder, where Va is a rotary speed given in the developing process. The normal driving section 235 serves to drive the rollers 4, 5 and the screw 22 at the rotary speed Va when the supply of the developing powder is terminated. The adjusting section 236 serves to adjust the set level of the toner density sensor 8 when a certain time is elapsed after the supply of the developing powder is terminated.

To exchange the developing powder D, the feeding-time driving section 234 is activated by switching an operation key 37 on. The normal driving section 235 also has a function of driving the rollers 4, 5 and the screws 22, 27 at a rotary speed Va given in the developing process by turning on a start key 38.

The adjusting section 236 has a function of stirring the developing powder by using the rollers 4, 5 and the screw 2 and feeding toner by driving the developing powder feeding mechanism 29 if the toner is short so that the output voltage of the toner density sensor 8 may reach the reference voltage VO of the developing powder appearing when forming an image.

In a case that the waste developing powder D is exhausted and the new one is fed, the exhausting screw 27 is rotated at the rotary speed Vb by the driving unit 32. Then, the waste developing powder D in the developing bath 2 is moved in the A direction (see FIG. 2) by virtue of the screw 27 so that the waste developing powder D may drop from the exhaust outlet 30 into the waste vessel 31.

Next, when the new developing powder D is fed, the rollers 4, 5 and the carrying screw 22 are driven at the rotary speed Vb. The shutter is opened so that the new developing powder D may flow from the feeding bath 20 into the cylinder 24.

The developing powder D is carried from the entry side to the inner side in the B direction through the carrying path inside of the conduit pipe 26. The developing powder D travels on the surface of the magnet roller in parallel to the shaft of the roller (in the thrusting direction). Unlike the developing process where the developing powder is constantly moved radially, when exchanging the developing powder, the splash of toner or carrier is more likely to take place.

The developing powder D is, however, carried at a slow speed through the carrying path by means of the carrying screw 22. The developing powder slowly travels on the surface of the photosensitive body 1. Hence, the developing powder is more attracted on the photosensitive body 1. This makes contribution to preventing the splash of toner and carrier.

The developing powder D overflown out of the opening 26*a* is progressively increased from the entry side to the inner side. Hence, the distribution of the developing powder D is not shifted toward the entry side. It means that no special stirring operation is required for feeding the developing powder uniformly. Then, the stirring roller 5 serves to feed the developing powder D in the developing bath 2.

The carrying screw 22 is used for carrying the developing powder D from the entry side to the inner side and provides excellent carrying efficiency. The extension of the carrying screw 22 to the tip of the rotary shaft 25 results in constantly moving the developing powder D in the B direction, thereby making the height of the developing powder D in the developing bath 2 irregular, which makes the toner density variable. Hence, the resulting copying image may be degraded.

To prevent the disadvantageous phenomenon, the stirring member 23 is provided on the inner side. This stirring member 23 provides no capability of carrying the developing powder in the B direction but a more excellent capability of stirring the developing powder radially than the carrying screw 22. Hence, the developing powder D is carried toward the inner side by the carrying screw 22 and is diffused radially by means of the stirring member 23 for the purpose of keeping the density of the developing powder D uniform in the developing bath.

Figure 19:
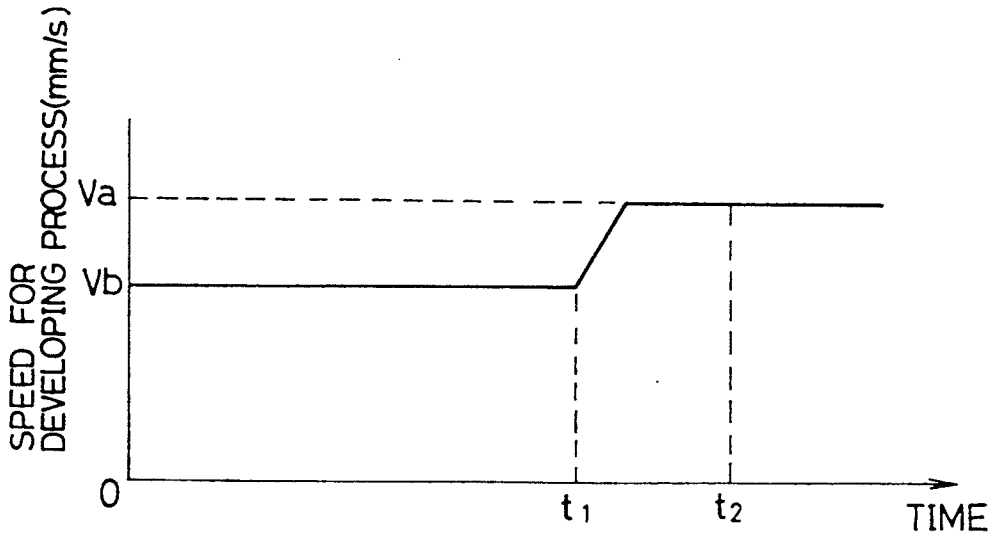
FIG. 19 is a graph showing a relation between a rotary speed of the rollers and screw and a time.

By the way, immediately after starting to feed the developing powder, the developing powder does not reach the toner density sensor 8 yet. Hence, the sensor 8 produces an unstable output voltage as shown in FIG. 19.

After the developing powder reaches the sensing surface, the sensor 8 gradually produces a higher output voltage. At a time point t1 when the supply of the developing powder is terminated, the density of the developing powder around the sensor 8 is not still made uniform, so that the sensor produces a unstable output voltage. At this time, the rotary speed of the rollers 4, 5 and the screws 22, 27 is switched from Vb to Va.

At a time point t2 when a certain time is elapsed after the supply of the developing powder is terminated, the flow of the developing powder becomes a normal flow. Hence, the toner density sensor 8 can produce a stable output voltage after the powder is stirred sufficiently. Then, the voltage is set up to be a reference voltage V0.

The supply of the toner after the initial supply is controlled so that the output voltage of the sensor 8 is made to be the reference voltage V0.

Since the setting level of the output voltage of the sensor is performed in a state that the sensor 8 produces a stable output after the new developing powder is fed, this eliminates a error involved in the reference voltage V0 and stables the sensing of the toner density.

In the embodiment above-mentioned, the reference voltage V0 is set newly when the new developing powder is fed into the developing bath, but the toner density sensor may be adjusted automatically or manually so as to output a signal having a predetermined voltage.

Further, by making the rotary speed of the rollers and the screws in feeding and exhausting the developing powder D slower than that in the developing process, the developing powder is allowed to slowly travel. This can prevent the splash of toner and carrier, resulting in protecting the inside of the image forming apparatus from being soiled by toner and carrier.

Many widely different embodiments of the present invention may be constructed without departing from the spirit and scope of the present invention. It should be understood that the present invention is not limited to the specific embodiments described in the specification, except as defined in the appended claims.

What is claimed is:

1. A developing unit comprising:
- a developing bath for containing a developing powder;
- a stirring roller disposed in said developing bath for development;
- a screw disposed in said bath for carrying a developing powder to feed it inside of said bath;
- control means for controlling said roller and said screw such that rotary speeds of said roller and said screw in a case of feeding a new developing powder are not equivalent to those in a case of development, respectively;
- a sensor for outputting a signal representing a toner density in said developing bath; and
- means for disabling said roller and said screw when the signal supplied from said sensor reaches a predetermined value.

2. A developing unit according to claim 1, wherein said control means includes means for controlling said roller and said screw such that rotary speeds of said roller and said screw in the case of feeding a new developing powder are faster than those in the case of development, respectively.

3. A developing unit according to claim 1, wherein said control means includes means for controlling said roller and said screw such that rotary speeds of said roller and said screw in the case of feeding a new developing powder are slower than those in the case of development, respectively.

4. A developing unit comprising:
- a developing bath for containing a developing powder;
- a stirring roller disposed in said developing bath for development;
- a screw disposed in said bath for carrying a developing powder to feed it inside of said bath;
- a sensor for outputting a signal representing a toner density in said developing bath;
- control means for controlling said roller and said screw such that, after the feeding process of a new developing powder is completed, rotary speeds of said roller and said screw in a case of feeding a new developing powder are not equivalent to those in a case of development; and
- reference means for determining a reference output value of said sensor after a predetermined time passes from the time when said rotary speeds of said roller and said screw controlled by said control means are equivalent to those in the case of development.

5. A developing unit according to claim 4, wherein said control means includes means for controlling said roller and said screw such that rotary speeds of said roller and said screw in the case of feeding a new developing powder are slower than those in the case of development, respectively.

6. A developing unit according to claim 5, wherein said reference means include means for setting an output voltage of said sensor as said reference output value.

7. A developing unit according to claim 5, wherein said reference means include means for adjusting said sensor so as to output said reference output value.

8. A developing unit comprising:

a developing bath for containing a developing powder;

a stirring roller for developing disposed in said developing bath;

a screw, disposed in said bath, for carrying a developing powder to feed it inside of said bath; and means for controlling said roller and said screw such that rotary speeds of said roller and said screw in a case of exhausting a waste developing powder are faster than those in a case of development, respectively.

9. A developing unit according to claim 8, wherein said unit further includes a sensor for outputting a signal representing a toner density in said developing bath and means for disabling said roller and said screw when the signal supplied from said sensor reaches a predetermined value.

10. A developing unit comprising:

a developing bath for containing a developing powder;

a stirring roller for development disposed in said developing bath;

a screw, disposed in said bath, for carrying a developing powder to feed it inside of said bath; and means for controlling said roller and said screw such that rotary speeds of said roller and said screw in a case of exhausting a waste developing powder are slower than those in a case of development, respectively.

11. A developing unit according to claim 10, wherein said unit further includes a sensor for outputting a signal representing a toner density in said developing bath and means for disabling said roller and said screw when the signal supplied from said sensor reaches a predetermined value.

12. A developing unit according to claim 10, wherein said unit further comprises a magnet roller disposed near an opening of said bath, and means for selectively positioning said developing bath at a first position where the developing process is performed or at a second position where said opening of said bath is opposed to a recovery device when exhausting said developing powder.

13. A developing unit comprising:

a developing bath for containing a developing powder;

a stirring roller for development;

means for driving the stirring roller;

a sensor for outputting a signal representing a toner density in said developing bath;

means for feeding new developing powder to said developing bath; and means for disabling said feeding means and said driving means when the signal supplied from said sensor reaches a predetermined value.

* * * * *

UNITED STATES PATENT AND TRADEMARK OFFICE

CERTIFICATE OF CORRECTION

PATENT NO. : 5,310,423

DATED : May 10, 1994

INVENTOR(S) : toyoka Aimoto and Masato Asanuma

It is certified that error appears in the above-indentified patent and that said Letters Patent is hereby corrected as shown below:

On the title page. page, Item [30], please change:
"October 31, 1991" to -- October 30, 1991 --

Signed and Sealed this

Twenty-seventh Day of September, 1994

*Attest:*

Bruce Lehman

BRUCE LEHMAN

*Attesting Officer*

*Commissioner of Patents and Trademarks*